US007010817B2

(12) United States Patent
Smith

(10) Patent No.: US 7,010,817 B2
(45) Date of Patent: Mar. 14, 2006

(54) POOL COVER BOX APPARATUS AND METHODS

(76) Inventor: Lanny R. Smith, 815 W. Blue Spruce Rd., Alpine, UT (US) 84004

( * ) Notice: Subject to any disclaimer, the term of this patent is extended or adjusted under 35 U.S.C. 154(b) by 0 days.

(21) Appl. No.: 10/701,645

(22) Filed: Nov. 4, 2003

(65) Prior Publication Data

US 2005/0091737 A1 May 5, 2005

(51) Int. Cl.
*E04H 4/10* (2006.01)

(52) U.S. Cl. ..... 4/502; 220/645; 220/DIG. 25

(58) Field of Classification Search ..... 4/500, 4/502, 510; 52/11; 220/644, 645, DIG. 25; 403/300, 363; 405/118, 121
See application file for complete search history.

(56) References Cited

U.S. PATENT DOCUMENTS 2,676,729 A * 4/1954 Neville, Jr. et al. ..... 220/645
4,457,441 A * 7/1984 McCloughan .... 220/DIG. 25 X
2002/0133871 A1 * 9/2002 Bertoni ..... 4/502

* cited by examiner

*Primary Examiner*—Robert M. Fetsuga
(74) *Attorney, Agent, or Firm*—Kulani Fisher; Rader, Fishman & Grauer PLLC

(57) ABSTRACT

Box apparatus is provided for containing a pool cover assembly to cover a swimming pool, comprising an elongated plastic box. The box apparatus comprises a plurality of sections of substantially identical unitary molded plastic members, a plurality of coupling elements to couple the sections together to form an elongated box with two sides, a bottom, an open top and at least one open end, and an end piece fastened to the box to close the open end. A method is provided for forming a pool cover box to contain a pool cover assembly for covering a swimming pool, comprising forming an elongated plastic box.

25 Claims, 6 Drawing Sheets

POOL COVER BOX APPARATUS AND METHODS

FIELD OF INVENTION

The present disclosure relates to swimming pools, and, more particularly, to pool cover box apparatuses and methods.

BACKGROUND

Swimming pool covers are often used for keeping the water free of trash, to shield the water from sunlight that could degrade protective chemicals in the water and for other purposes. Automatic pool covers are often preferable over manually-operated covers, because the cover can be easily extended when the pool is not in use and retracted during use. In most cases, a pool cover box is located at one end of the pool to hold the cover, motor, winding reel and cable.

FIG. 1 shows a generalized schematic of a swimming pool 10 having a pool deck 12 and coping walls 14 surrounding the pool 10. A pool cover 16 extends from a pool cover assembly 18 in a pool cover box 20 disposed at one end of the pool 10. A leading edge bar 22 at the front edge of the pool cover 16 rides in a track encapsulation 24 along the interior walls of the pool 10. Pool cover assembly 18 includes a pool cover motor 21 and a cover wind-up cylinder 26. When the pool 10 is not in use, leading edge bar 22 pulls cover 16 from pool cover box 18 across the length of swimming pool 10. To use the swimming pool 10 the cover 16 is retracted by the pool cover assembly 18 into a cover assembly box 20 causing leading edge bar 22 to also retract into the assembly box 20.

FIG. 2 shows a prior art pool cover assembly 18 and pool cover box 20 in cross-section. A bracket assembly 30 is mounted to the back wall 32 of box 20 to support a lid 34 mounted over a trough 35 in the box 20. A reel 36 is disposed in the trough 35 of box 20 to roll up or unwind the pool cover 16 as it retracts or extends through a space 38.

Prior pool cover boxes have been made in several varieties, such as concrete boxes poured in place or wooden boxes, usually constructed on site. A concrete box is very expensive to make, since it must be formed and poured on location. Also, as a plastic pool cover is extended and retracted relative to the pool and the box, it rubs against parts of the concrete box, wearing the pool cover prematurely. A wooden box is extremely heavy and difficult to maneuver into place. Furthermore, a wooden box tends to deteriorate and warp in the weather, requiring repair and replacement. Metal boxes have also been constructed, but the weight involved makes such boxes cumbersome and expensive.

SUMMARY

In one implementation of the present disclosure, a box apparatus is provided for containing a pool cover assembly to cover a swimming pool, comprising an elongated plastic box.

In another implementation, a box apparatus is provided for containing a pool cover assembly to cover a swimming pool. The box comprises a plurality of sections of substantially identical unitary molded plastic members, a plurality of coupling elements to couple the sections together to form an elongated box with two sides, a bottom, an open top, at least one open end, and an end piece fastened to the box to close the open end.

In another implementation, a method is provided for forming a pool cover box to contain a pool cover assembly for covering a swimming pool, comprising forming an elongated plastic box.

BRIEF DESCRIPTION OF THE DRAWINGS

The above-mentioned features and other features and advantages of this disclosure will become more apparent and the disclosure will be better understood by reference to the following description of an exemplary implementation taken in conjunction with the accompanying drawings, wherein.

Throughout the drawings, identical reference numbers may designate similar, but not necessarily identical, elements. The examples herein illustrate selected implementations of the disclosure in certain forms, and such exemplification is not to be construed as limiting the scope of the disclosure in any manner.

DETAILED DESCRIPTION

Figure 1:
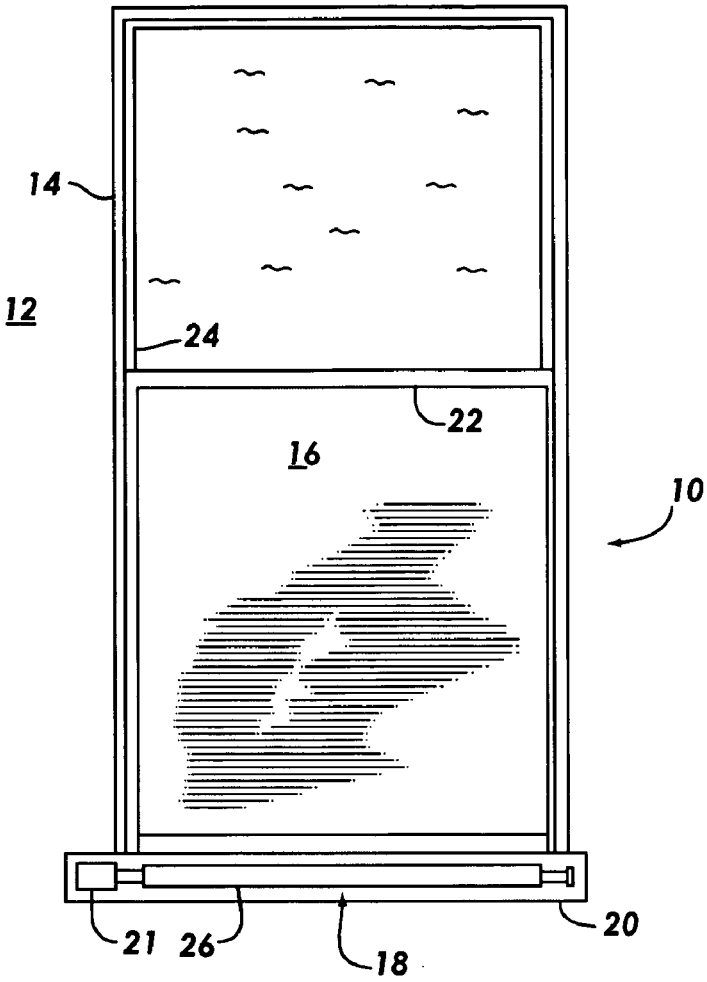
FIG. 1 (Prior Art)
FIG. 1 is a generalized schematic view of a pool showing the location of a pool cover assembly and pool cover box.
Figure 2:
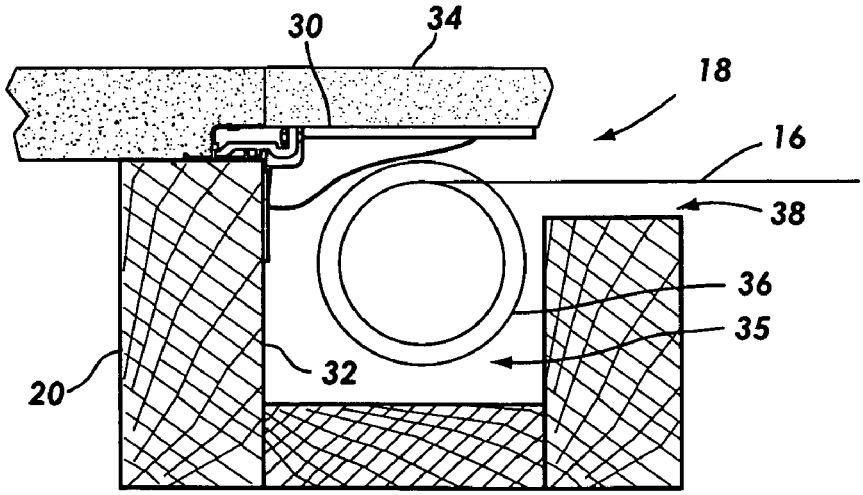
FIG. 2 (Prior Art)
FIG. 2 is a partial cross-sectional view of a conventional pool cover box and cover assembly.
Figure 3:
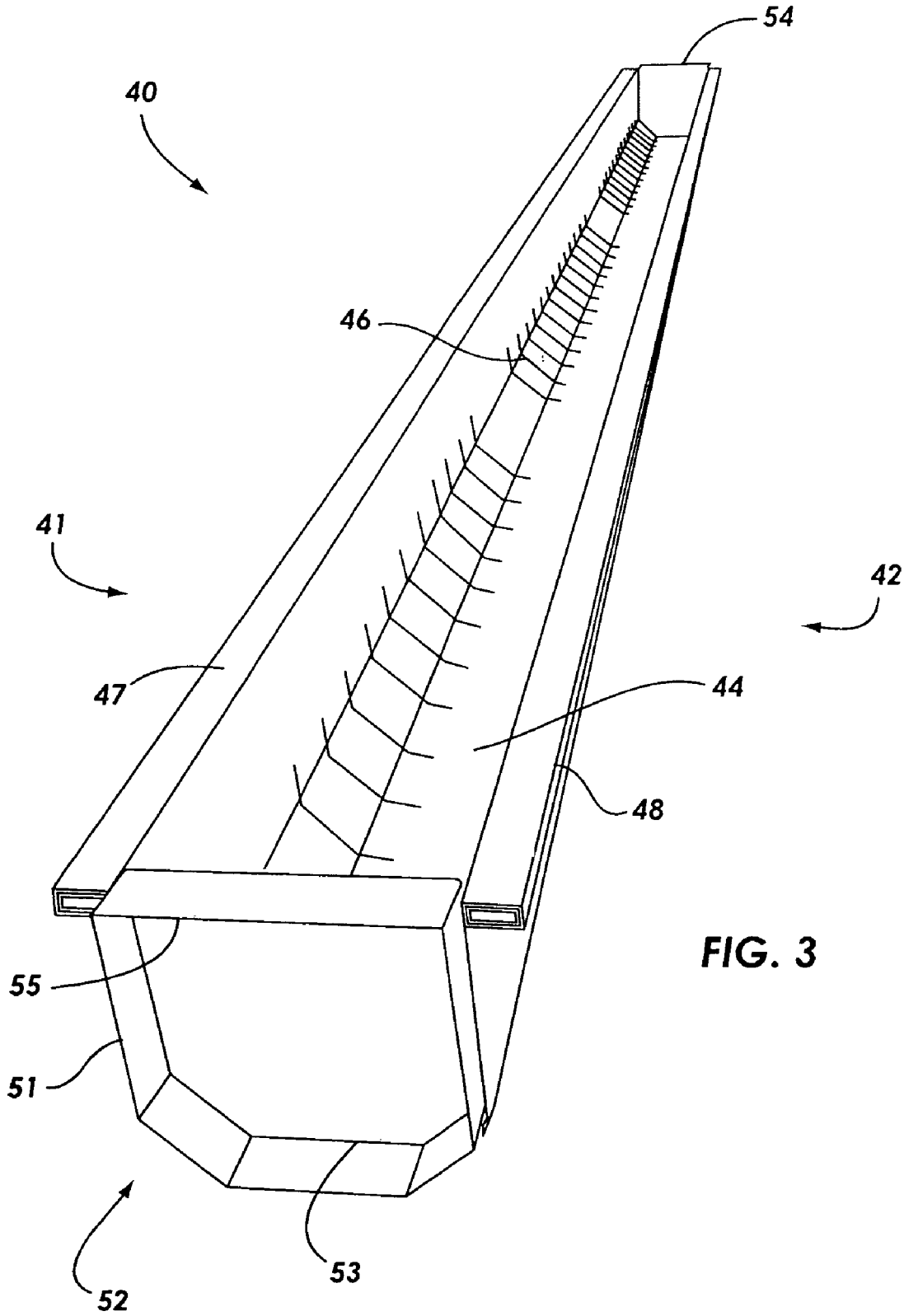
FIG. 3 is a perspective view of the pool cover box according to one implementation of the present disclosure.
Figure 4:
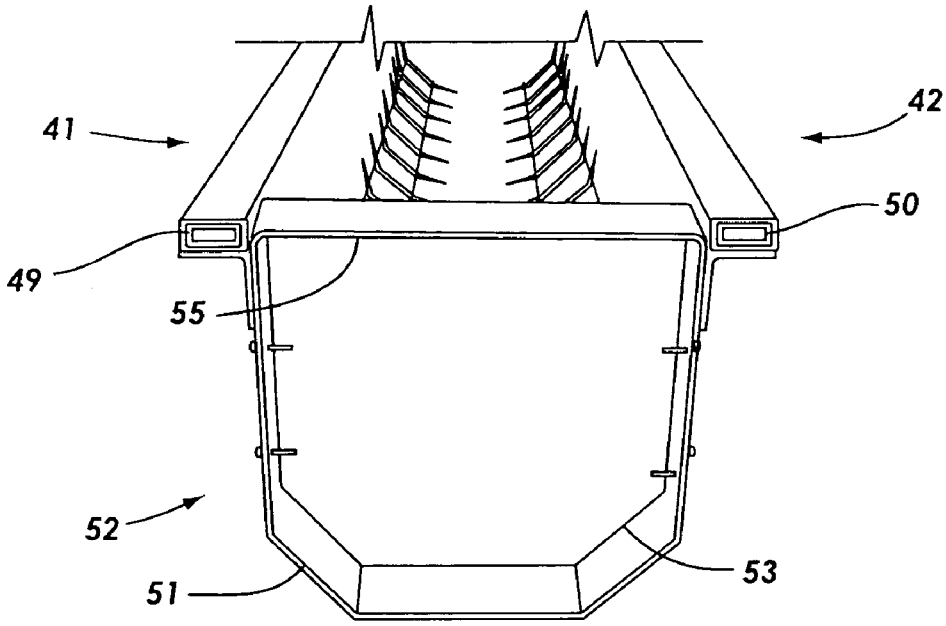
FIG. 4 is a perspective view of a front portion of the pool cover box shown in FIG. 3.
Figure 5:
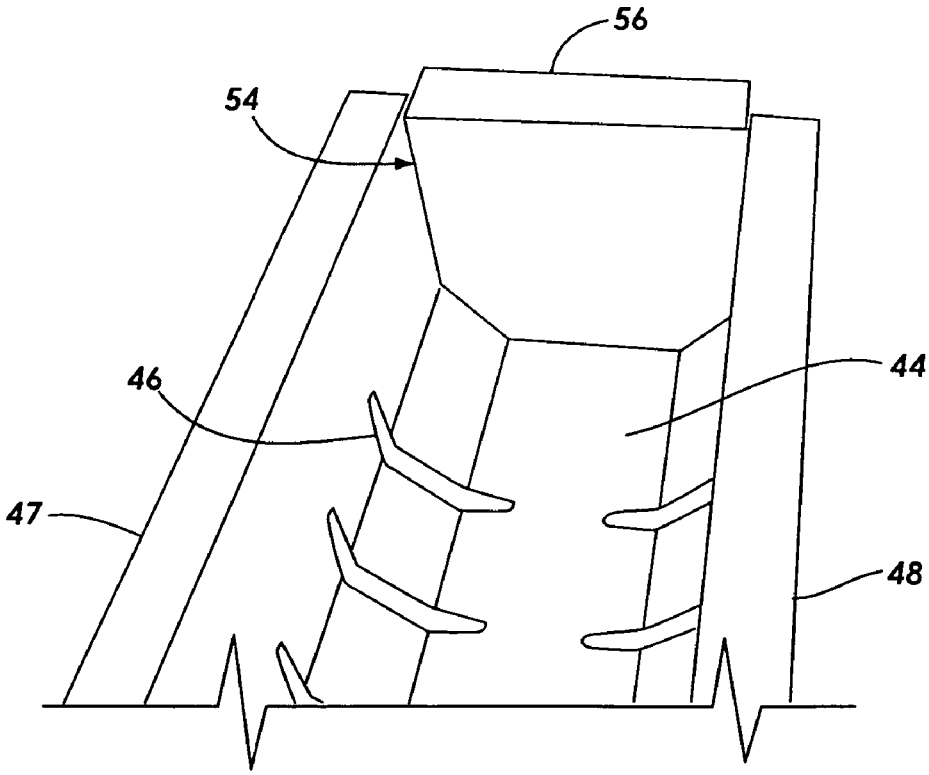
FIG. 5 is a perspective view of a back portion of the pool cover box shown in FIG. 3.

Referring now to FIGS. 3, 4 and 5, perspective views are shown of a pool cover box 40 according to an implementation of the present disclosure. Looking first at FIG. 3, pool cover box 40 is a thermoplastic molded box having sides 41 and 42 and inside surfaces, including bottom 44, formed from the same molded plastic piece. Box 40 may be made of any moldable thermoplastic material, such as ABS or polyethylene and may have a thickness of approximately one quarter inch. Box 40 may be composed of multiple sections that are separately molded and then fastened together, as will be discussed later. Although the length varies greatly, it is likely that box 40 may be in the range of 16–24 feet long, comprising sections of 8 feet or 4 feet, which may be cut to whatever specific length may be needed, as discussed later. The box may be about 14 inches deep by 14 inches wide. A plurality of ribs 46 are spaced along the length of box 40, each rib 46 running transversely from side 41 to the bottom 44 of box 40.

End pieces 52 and 54 are coupled to walls 41 and 42 at opposite ends of the pool cover box 40. End piece 52 is formed with a lip 55 to form part of a frame structure 51 extending around the periphery of end piece 52. An enclosure member 53 is recessed from frame structure 51 and closes off the end of the pool cover box 40.

As shown in FIG. 4, elongated support members 47 and 48 run longitudinally along the sides 41 and 42 of the box 40. Support members 47 and 48 may be formed with sections of hollow square metal tubing 49 and 50 which are molded into the sides 41 and 42 of pool cover box 40 to provide strength and to maintain the integrity of the pool cover box 40. Tubing 49 and 50 may be single pieces each running the length of a section of the pool cover box 40. Tubing 49 and 50 may be one inch by two inches in transverse profile and may extend the length of a section, which could be four or eight feet long. The plastic material forming sides 41 and 42 is wrapped around the metal tubing 49 and 50 and attached to the outside of sides 41 and 42. Metal tubing 49 and 50 also provides a solid material on which to attach brackets and other members needed to dispose lids over the cover box.

FIG. 4 is a close-up partial perspective view of pool cover box 40 showing end piece 52 in more detail. Frame structure 51 forms a hexagon or a rough U-shape with a top having a width which is approximately the same as the width of the pool cover box. As used herein and in the appended claims, U-shape shall be broadly understood to mean any shape which includes two side portions and a bottom. Enclosure member is recessed from structure 51. End piece 52, as well as end piece 54 (FIG. 5) are sized and shaped to conform to the inner shape of the pool cover box 40. Accordingly, end pieces 52 and 54 can be moved along the length of box 40 to provide whatever custom length of the box may be needed. After an end piece 52 or 54 has been moved, any excess portion of the box 40 (not shown) can be removed by cutting off that portion. The lip 55 at the top of end piece 52 adds strength to the piece.

FIG. 5 shows end piece 54 in more detail. End piece 54 is substantially identical to end piece 52 and conforms to the size and shape of the inner dimensions of box 40. Accordingly, piece 54 may also be moved along the length of box 40 to provide whatever length may be desired. The excess part of the box (not shown) may be cut off or simply left alone. End piece 54 also has a top lip 56 and an external frame structure (not shown) substantially identical to structure 51, to provide strength to end piece 54.

Figure 6:
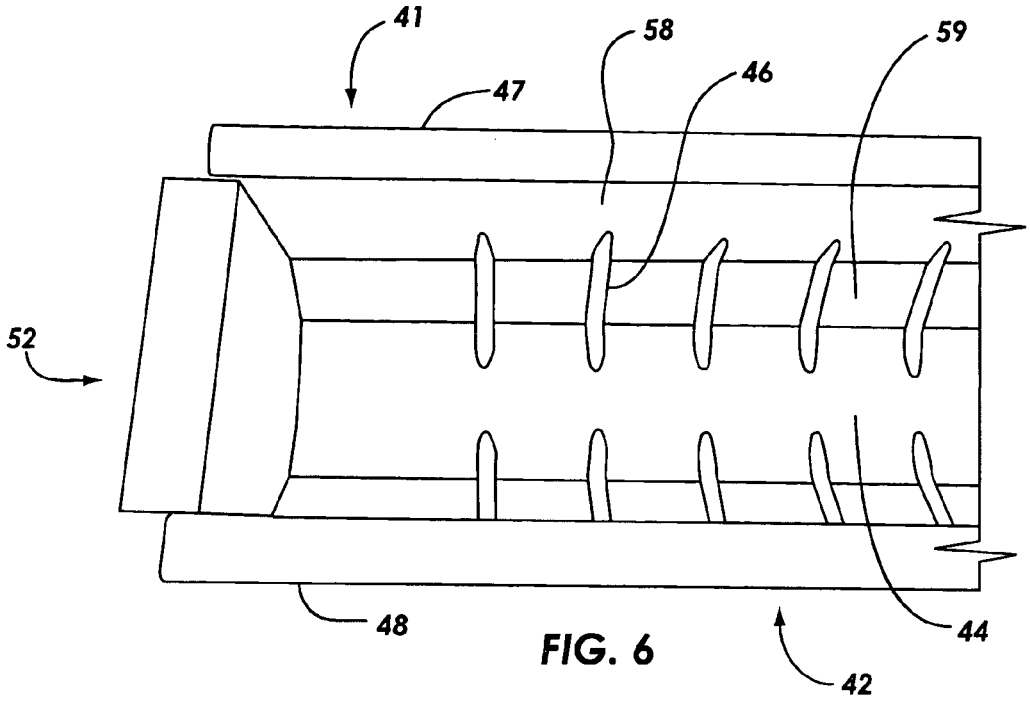
FIG. 6 is a plan view of a portion of the pool cover box shown in FIG. 3.

FIG. 6 is a partial plan view of box 40 showing the bottom 44 and inside surfaces 58 and 59 of side 41. Ribs 46 are spaced along the length of box 40 and run transversely across surfaces 58 and 59 and a portion of bottom 44. Ribs 46 add strength to the sides 41, 42 and the inner surface of the bottom 44 of pool cover box 40. Ribs 46 are similarly disposed on the inside surfaces of side 42.

Figure 7:
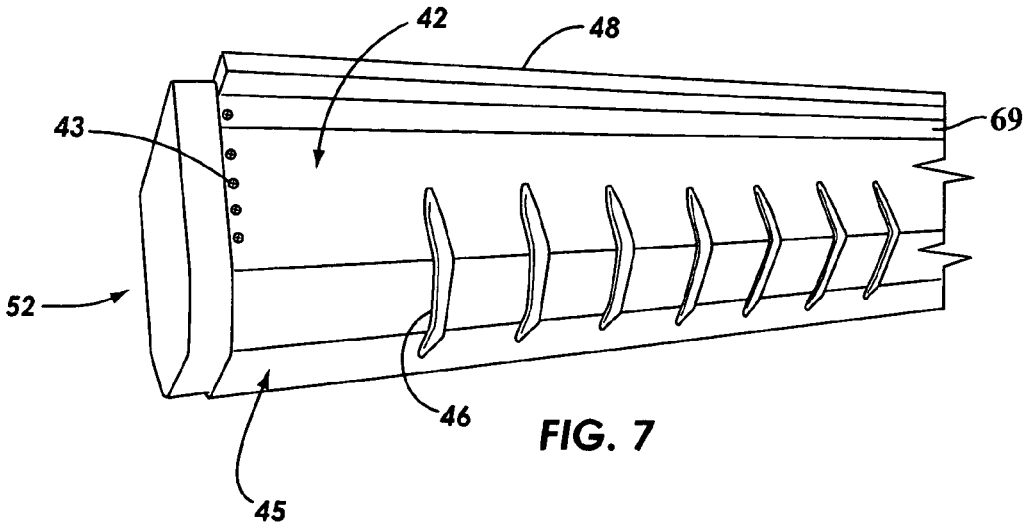
FIG. 7 is a perspective view of the bottom of the pool cover box shown in FIG. 3.

FIG. 7 is a partial perspective view showing part of side 42 and the outside 45 of bottom 44. Ribs 46 are also apparent on the outside of pool cover box 40. An elongated flap 69 runs below support member 48 and is integral with the material used to form the pool cover box 40. Flap 69 is the extended portion of plastic that extends around metal tube 50 to form support member 48. Screws 43 extend through side 42 and flap 69 to secure end piece 52.

Figure 8:
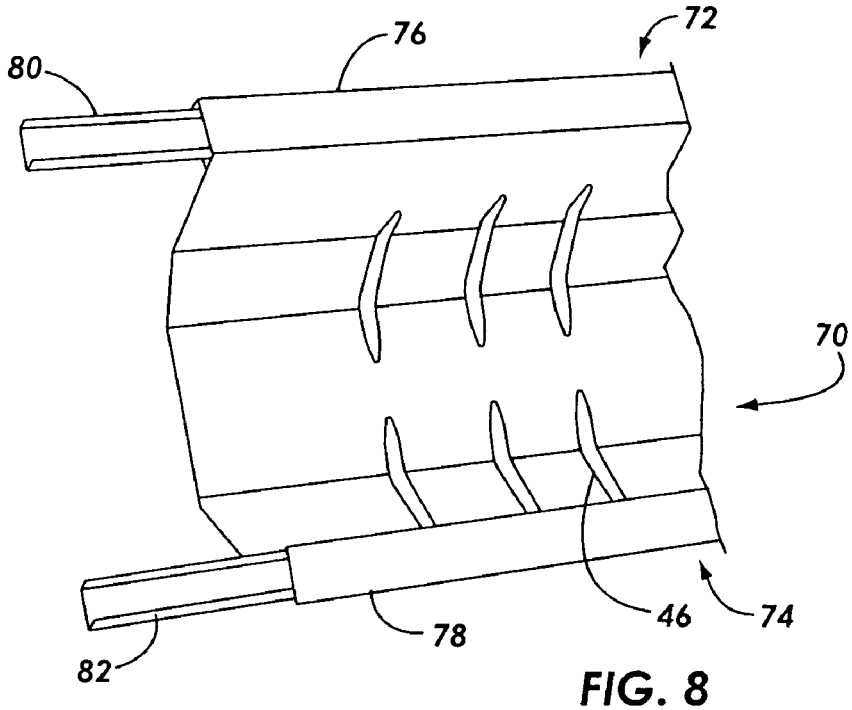
FIG. 8 is a partial plan view showing the use of a splice piece in assembling sections of the pool cover box shown in FIG. 3.

FIG. 8 is a partial plan view showing part of a section 70 of the pool cover box. Sides 72 and 74 include elongated support members 76 and 78, substantially the same as support members 47 and 48 shown in FIG. 3. Although not shown, support members 76 and 78 include hollow square metal tubing similar to tubing 49 and 50 shown in FIG. 3. In order to couple section 70 to an adjoining section (not shown), channel members 80 and 82 are inserted into the hollow metal tubing in support members 47 and 48. Channel members 80 and 82 may be U-shaped metal members sized to fit inside of the hollow metal tubing (not shown). Channel members 80 and 82 may be about 18 inches long and may be made of channel-shaped steel.

Figure 9:
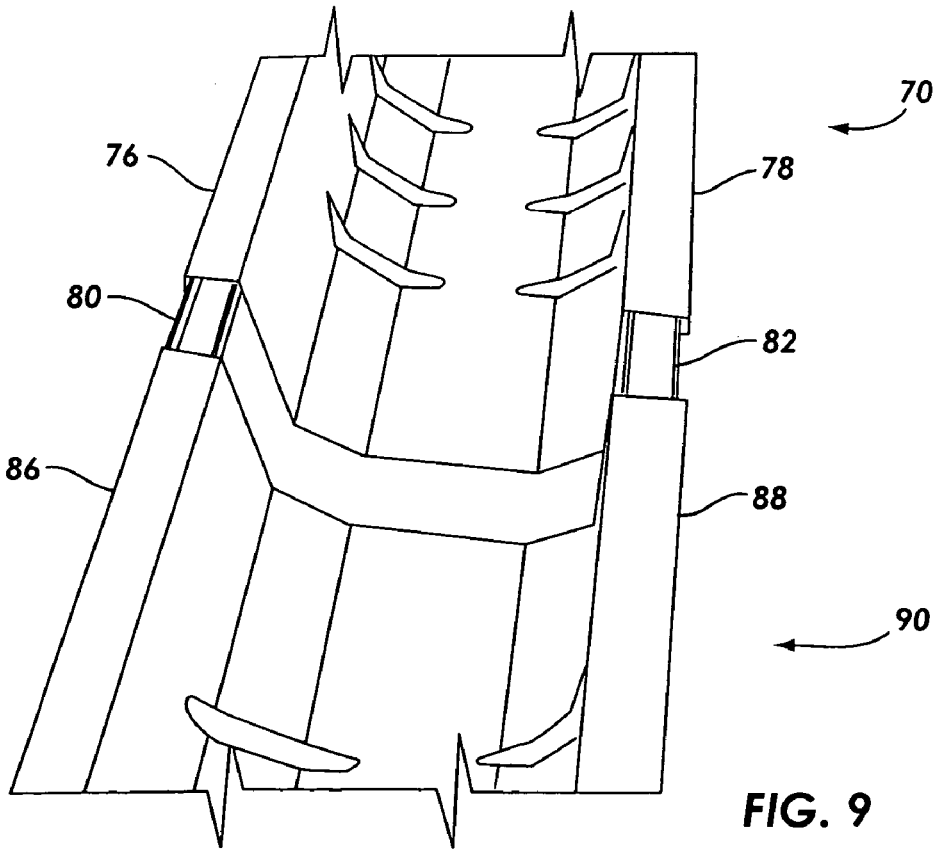
FIG. 9 is a partial perspective view showing partially assembled sections of the pool cover box shown in FIG. 3.

Referring now to FIG. 9, section 70 is shown in partially completed assembly with an adjoining section 90 of pool cover box. Channel members 80 and 82 have been inserted into the hollow metal tubing (not shown) of elongated support members 86 and 88. Accordingly, channel members 80 and 82 function to splice the adjoining sections 70 and 90 together.

Figure 10:
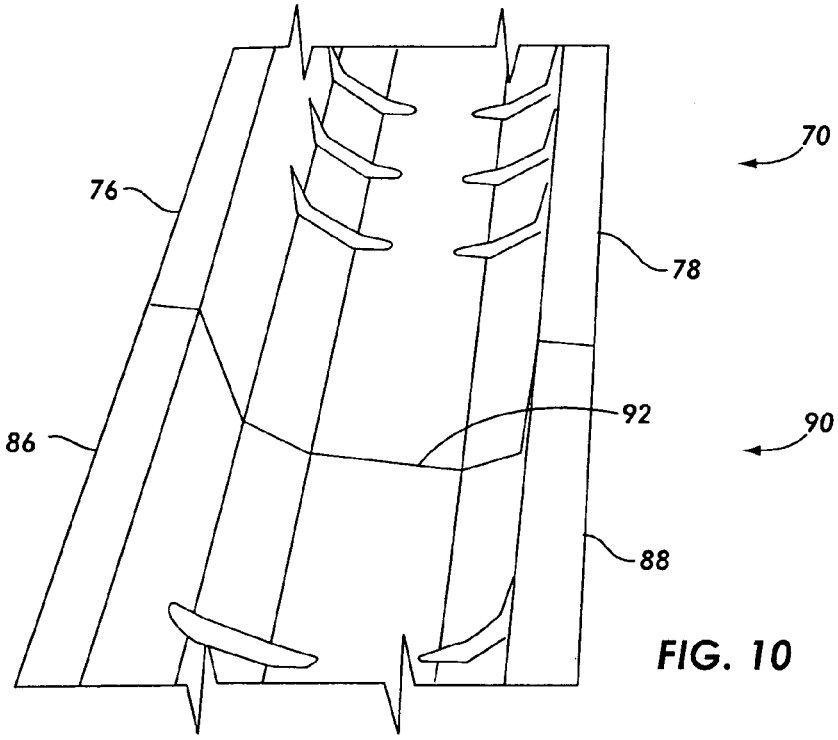
FIG. 10 is a perspective view showing the assembled sections shown in FIG. 9.

FIG. 10 is a plan view, showing sections 70 and 90 joined together. Sections 70 and 90 may be joined together in a butt joint. Only a faint line for a joint 92 can be seen where sections 70 and 90 abut. The box 40 may be made watertight by taping, caulking or otherwise sealing the joint 92. Selective water tightness may be desirable in order to drain water out of the box 40 only at selected drains, thereby preventing water seeping into areas where water might be injurious. Likewise, making the box watertight may be desirable to keep water from seeping into box 40, thereby causing rust or deterioration in the pool cover assembly.

Figure 11:
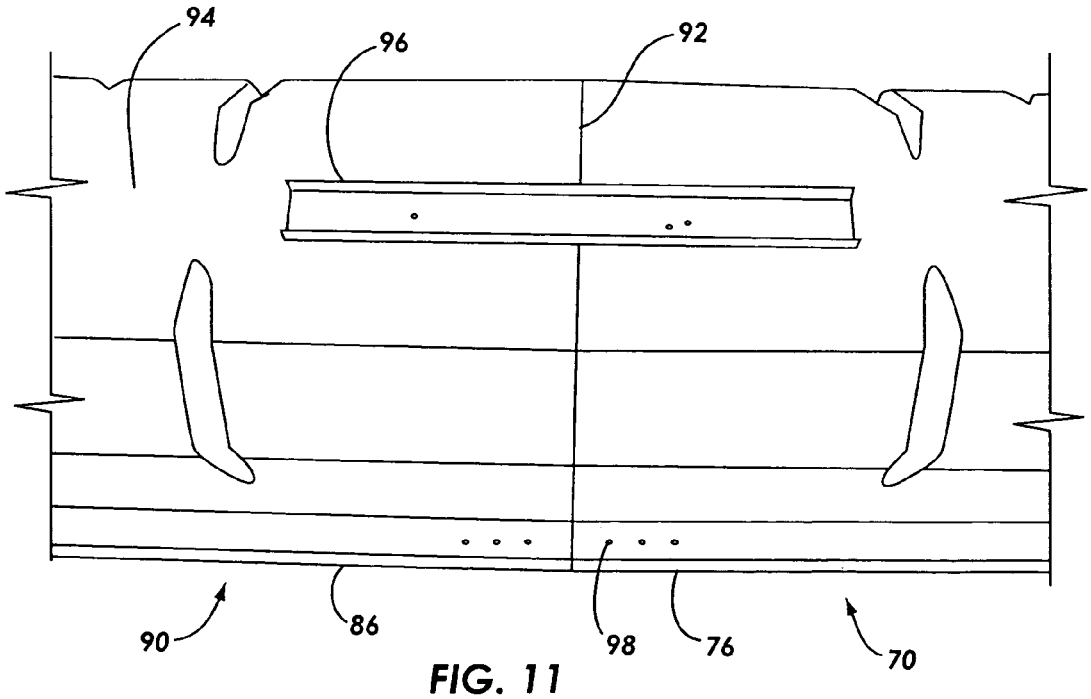
FIG. 11 is a partial perspective view showing reinforcement of the assembled sections shown in FIG. 9.

FIG. 11 is a plan view of the bottom 94 of sections 70 and 90. The joint 92 may likewise be taped, caulked or otherwise sealed from the outside of the box 40. Moreover, the coupling between sections 70 and 90 may be strengthened by attaching a channel member 96 to bottom 94 so as to extend longitudinally along bottom 94 across joint 92. Other channel members (not shown) may be coupled on the bottom 94 transversely around the joint to strengthen the coupling of adjoining sections. A plurality of screws or other fasteners 98 are connected to the undersides of support members 76 and 86, near the joint 92 to secure the channel member 80 relative to the support members 76 and 86 (see FIG. 9). Similarly, screws (not shown) are connected to the undersides of support members 78 and 88 (see FIG. 9) to secure the channel member 82 relative to the support members 78 and 88.

Fabrication of the pool cover box of the present disclosure is carried out by conventional vacuum form processes. The entire pool cover box of the present disclosure can be fabricated in a single process, including forming the support members with the hollow steel tubes therein. Assembly of adjoining sections may require only a few minutes of assembly time, and an entire pool cover box may be fully assembled in a matter of minutes, rather than hours required to fabricate prior art pool cover boxes.

It should be understood that other types of plastic fabrication of the pool cover box fall within the scope of the present disclosure. Thus, the subject pool cover box may also be made from vacuum molded sections that are individually formed and then fastened together. Moreover, the pool cover box may also be made by injection molding the plastic box, in one or more sections and then fastening the sections together. Other such plastic fabrication methods may be used to make a pool cover box with the scope of the present disclosure.

The apparatus and methods described above provide a number of advantages over prior art pool cover boxes. The thermoplastic pool cover box is much more light-weight and portable than prior boxes. One eight foot section could easily be lifted and positioned where needed. In contrast, a metal or wood box of comparable size might weigh two to three times or more than the present box. The pool cover box of the present disclosure may be assembled in sections of 4 feet, 8 feet or may even be provided in 2 feet increments. In addition, the pool cover box may be further adjusted in length by moving one or both of the ends.

In addition, the pool cover box of the present disclosure is relatively easy and fast to fabricate, being manufactured in a single vacuum form molding process. Further, the present pool cover box, being made of a thermoplastic material, is durable and impervious to weather. Moreover, the thermoplastic material of the pool cover box does not abrade or prematurely wear out the pool cover. The elongated support members running along the sides of each section of the box provide substantial rigidity and strength. Further, the channel members functioning as splices within the hollow steel members provide strength to the coupling sections, as do the channel members on the underside of the box attached across adjoining sections of the box. The waterproof nature of the pool cover box of the present disclosure keeps stray water from seeping into the box and prevents water from flowing out, except at specified drains.

While this disclosure has been described as having a preferred design, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An apparatus for containing a pool cover assembly to cover a swimming pool, the apparatus comprising:

an elongated plastic box having two sides, a bottom, and at least one end piece;

an elongated, hollow support member running substantially along a length of the elongated plastic box;

an elongated, hollow tube inserted within the elongated, hollow support member and running substantially along a length of the hollow support member, wherein the elongated plastic box comprises a plurality of separate plastic sections coupled together, each plastic section having the elongated, hollow support member running substantially along the length of the plastic section with the elongated, hollow support tube inserted within the elongated, hollow support member and running substantially along the length of the elongated, hollow support member; and at least one splice member configured to couple two adjoining plastic sections together, wherein the at least one splice member is inserted within at least a portion of each of the elongated, hollow tubes of the two adjoining plastic sections.

2. The apparatus of claim 1, wherein the box is substantially U-shaped.

3. The apparatus of claim 1, wherein the box is made of molded thermoplastic material.

4. The apparatus of claim 1, wherein the two sides, the bottom, and the at least one end piece are sealed together to form a substantially watertight pool cover box.

5. The apparatus of claim 1, further comprising a second elongated, hollow support member running substantially along the length of the elongated plastic box; and a second elongated, hollow tube inserted within and running substantially along a length of the second elongated, hollow support member.

6. The apparatus of claim 1, wherein the elongated, hollow tube comprises steel tubing.

7. The apparatus of claim 6, wherein the steel tubing is substantially rectangular in cross-sectional shape.

8. The apparatus of claim 1, wherein the at least one end piece includes:

a frame shaped to conform to ma interior surface formed by the two sides and the bottom of the elongated plastic box; and an enclosure member shaped to fit within the frame, the enclosure member being recessed within the frame structure.

9. An apparatus for containing a pool cover assembly to cover a swimming pool, the apparatus comprising:

an elongated plastic box having two sides, a bottom, and at least one end piece, wherein the at least one end piece is movable to be selectively positioned along a length of the elongated plastic box;

an elongated, hollow support member running substantially along the length of the elongated plastic box; and an elongated, hollow tube inserted within the elongated, hollow support member and running substantially along a length of the hollow support member, wherein the at least one end piece is movable to he selectively positioned along the length of the elongated plastic box.

10. The apparatus of claim 1, wherein the cross-section of the at least one splice member is substantially U-shaped.

11. An apparatus for containing a pool cover assembly to cover a swimming pool, the apparatus comprising:

a plurality of sections of molded plastic members, each of the sections including two sides, a bottom, a plurality of elongated, hollow support members, the plurality of elongated, hollow support members including a first hollow support member and a second hollow support member running substantially along a length of each of the plurality of sections, and a plurality of elongated, hollow tubes, each of the elongated, hollow tubes being inserted within one of the plurality of elongated, hollow support members, wherein the plurality of elongated, hollow tubes includes a first tube inserted within and running substantially along a length of the first hollow support member and a second tube inserted within and running substantially along a length of the second hollow support member; and a plurality of channel members configured to axially couple adjacent sections of the plurality of sections together.

12. The apparatus of claim 11, wherein each of the plurality of channel members is inserted within the elongated, hollow tubes of the adjacent sections.

13. The apparatus of claim 11, further comprising a plurality of ribs spaced along the length of each of the plurality of sections, each of the plurality of ribs being configured transverse to the length of each of the plurality of sections.

14. The apparatus of claim 13, wherein the plurality of ribs are configured to extend transversely along the sides of each of the plurality of sections.

15. The apparatus of claim 11, further comprising a plurality of bottom coupling elements, each of the bottom coupling elements being configured to couple together bottoms of adjacent sections of the plurality of sections.

16. The apparatus of claim 11, wherein the plurality of sections are each molded thermoplastic material.

17. The apparatus of claim 11, wherein the plurality of sections are each substantially U-shaped.

18. The apparatus of claim 11, wherein at least two of the plurality of sections are of different lengths to accommodate the size of the pool cover assembly.

19. The apparatus of claim 11, further comprising a first end piece and a second end piece attached to the ends of the axially coupled plurality of sections to form an elongated plastic box.

20. The apparatus of claim 19, wherein the first end piece and the second end piece comprise plastic.

21. The apparatus of claim 19, wherein at least one of the first end piece and the second end piece is movable to be selectively positioned along the length of the elongated box.

22. The apparatus of claim 19, wherein the plurality of sections and the first and second end pieces are sealed together to form a substantially watertight pool cover box.

23. The apparatus of claim 19, wherein at least one of the first end piece and the second end piece comprises:

a frame shaped to conform to an interior surface formed by the two sides and the bottom of the elongated plastic box; and an enclosure member shaped to fit within the frame, the enclosure member being recessed within the frame structure.

24. The apparatus of claim 11, wherein the cross-section of each of the plurality of elongated, hollow support tubes is substantially rectangular in shape.

25. The apparatus of claim 24, wherein the plurality of channel members comprise substantially U-shaped members configured to be fittingly received in the plurality of elongated, hollow support tubes.

* * * * *

UNITED STATES PATENT AND TRADEMARK OFFICE

CERTIFICATE OF CORRECTION

PATENT NO. : 7,010,817 B2
APPLICATION NO. : 10/701645
DATED : March 14, 2006
INVENTOR(S) : Lanny R. Smith It is certified that error appears in the above-identified patent and that said Letters Patent is hereby corrected as shown below:

Column 6,
Line 5, change "a frame shaped to conform to ma interior surface" to -- a frame shaped to conform to an interior surface --.
Line 22, change "the at least one end piece is movable to he selectively" to -- the at least one end piece is movable to be selectively --.

Signed and Sealed this

Fourth Day of July, 2006

JON W. DUDAS
*Director of the United States Patent and Trademark Office*